United States Patent [19]

Glowacki

[11] 4,085,703

[45] Apr. 25, 1978

[54] PAINTING SHIELD

[76] Inventor: Frank J. Glowacki, 10801 Vickers Ave., Garden Grove, Calif. 92640

[21] Appl. No.: 821,265

[22] Filed: Aug. 3, 1977

Related U.S. Application Data

[63] Continuation of Ser. No. 670,599, Mar. 26, 1976, abandoned.

[51] Int. Cl.[2] ..... B05C 11/00

[52] U.S. Cl. ..... 118/504

[58] Field of Search ..... 118/504, 505, 301; 24/67.7

[56] References Cited

U.S. PATENT DOCUMENTS

| | | | |
|---|---|---|---|
| 314,769 | 3/1885 | Yeiser | 24/67.7 |
| 757,937 | 4/1904 | Lukes | 24/67.7 |
| 799,873 | 9/1905 | Senge | 24/67.7 |
| 2,289,136 | 7/1942 | Matter | 118/504 |
| 2,484,607 | 10/1949 | Cherem | 118/504 |
| 2,538,743 | 1/1951 | Alston | 118/504 |
| 2,545,638 | 3/1951 | Wheatley | 118/504 |
| 3,536,041 | 10/1970 | Hill | 118/504 |
| 3,693,589 | 9/1972 | Knox | 118/504 |
| 3,942,472 | 3/1976 | McAlister | 118/504 |

FOREIGN PATENT DOCUMENTS

| | | | |
|---|---|---|---|
| 581,704 | 10/1946 | United Kingdom | 118/504 |

*Primary Examiner*—James Kee Chi

*Attorney, Agent, or Firm*—Knobbe, Martens, Olson, Hubbard & Bear

[57] ABSTRACT

An extremely versatile spray painting shield includes a flat reinforcing member attached to an elongate handle. The shield permits a painter or his assistant to properly support the shield while keeping his arms and hands out of the spray pattern. The reinforcing member is attached to rotate relative one end of the handle. A spring clip mounted on the reinforcing member is used to hold large flat shields, many of which are disposable, for preventing paint from falling on selected areas. The flat shields may be cut or combined to conform with the perimeter of protected items, and the reinforcing member may conveniently include a metal edge used for scraping or occasional brush work.

3 Claims, 9 Drawing Figures

FIG. 5.
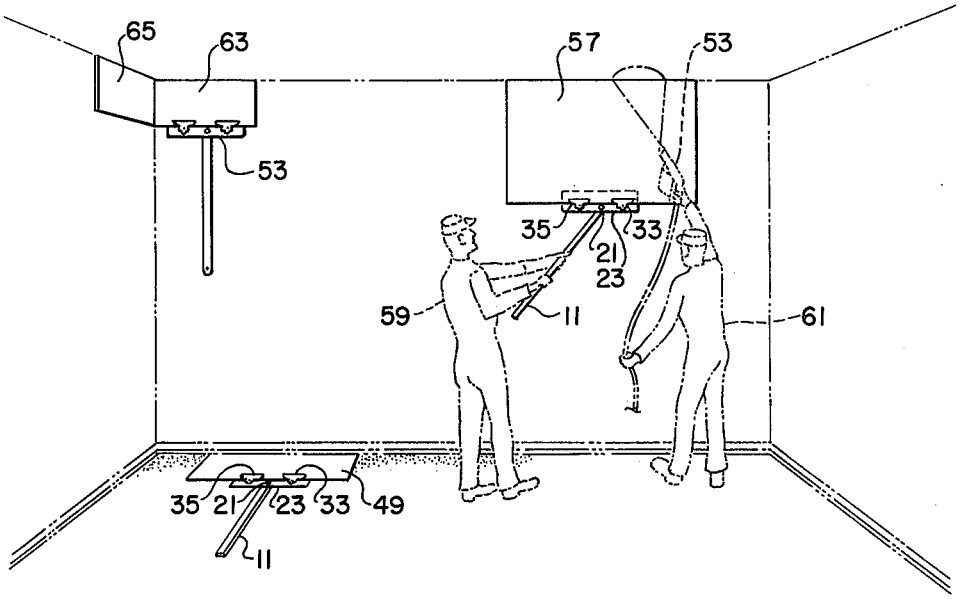
FIG. 6.
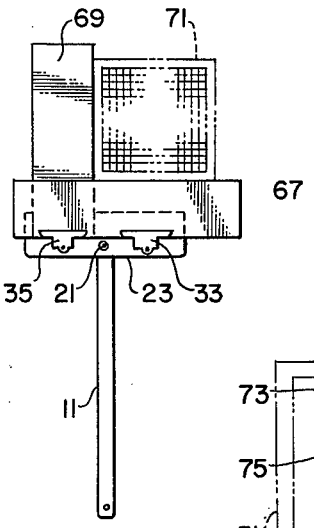
FIG. 7.
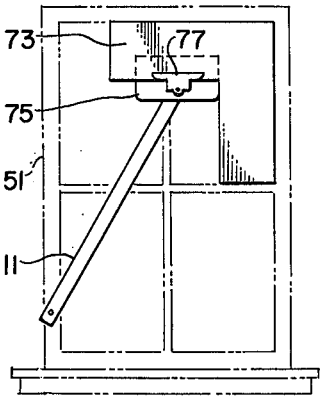
FIG. 8.
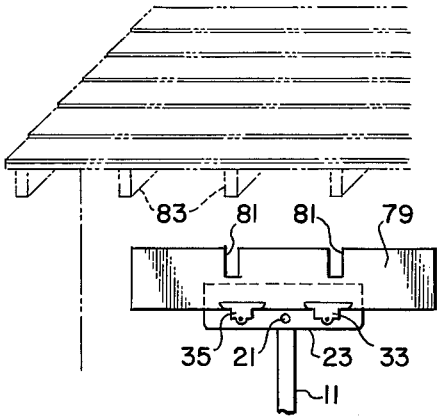
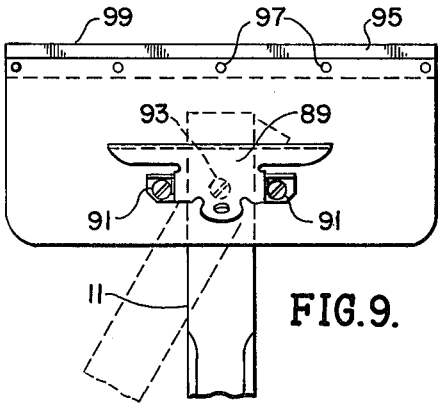
FIG. 9.

PAINTING SHIELD

This is a continuation of application Ser. No. 670,599, filed Mar. 26, 1976 now abandoned.

BACKGROUND OF THE DISCLOSURE

This invention relates to painting shields and, more specifically, to shields used for prohibiting paint from falling on protected areas during spray painting operations.

While many painting shields have been developed in the prior art, most such shields which are commercially sold are adaptable to brush and roller painting only, and are not specifically adapted to use by a spray painter. As a consequence, most professional painters using spray gun equipment have become accustomed to cutting large pieces of flat cardboard which the painter may hold in his hand to mask surfaces which are not to be painted. While this masking technique is satisfactory for some operations, it has been found to be highly unsatisfactory when airless spraying equipment is used, since the spraying equipment emits paint at extremely high velocity so that the paint spray itself can injure the painter if his arm or hand is placed in its trajectory.

Furthermore, such cardboard pieces which are commonly used are not well adapted to painting ceilings while masking walls, for example, since the painter is forced to stand on a ladder or other support while holding the shield member in one hand and a spray gun in the other hand. This entire operation places the painter in a relatively unstable position so that, particularly when using airless spraying equipment, he is subjected to a substantial risk of injury.

Painting shields have, in the prior art, included handles, most of which are relatively short, which permit a painter to firmly grasp the shield. These handles have required that the painter place his hand in close proximity to the location to be sprayed, risking, at the very least, painting of his hand, and in more serious situations a substantial injury to his hand or arm.

SUMMARY OF THE INVENTION

The present invention alleviates these difficulties of the prior art and protects the painter from injury, even when airless spraying equipment is used, by providing an elongate handle which is rotatably connected to the shield member so that the painter in all instances can keep his arms and hands well out of the path of the spraying equipment.

The device includes an elongate handle which is attached to a flat rigid reinforcing member, as by a bolt which permits relative rotation of these elements. The reinforcing member supports a spring clip which is used to clamp a shield member between the spring clip and the reinforcing member, the shield generally extending well beyond the perimeter of the reinforcing structure.

A wing nut may be used to tighten the handle and reinforcing member to frictionally engage one another to adjust the ease of rotation of these two elements.

The apparatus is specifically adapted to use with discardable shields, such as those made of cardboard, and permits the use of the apparatus with a variety of such shields, each of which may be cut to a perimeter permitting the shielding of various outline patterns such as may be required, for example, for painting the eaves outside of a building or for painting around windows or doorways.

As the painter moves from location to location, shielding various items with the shield of the present invention, he will find it helpful to rotate the handle relative the reinforcing member and shield to insure that in all instances his arms and hands are well out of the path of the airless spray.

An additional feature of the present invention provides a sharp scraping perimeter edge on the reinforcing member to permit the painting shield to be used as a tool for occasionally scraping areas to be painted. In addition, this edge will provide a guide for occasional brush work which must be done in specific locations during a spray painting operation.

The features of the present invention are best understood through a reference to the drawings, in which:

FIG. 5 is a perspective view showing the use of the painting shield holder and accompanying shields for painting various portions of a wall and ceiling in a typical room;

FIG. 6 shows the painting shield holder of the present invention combined with a pair of painting shields attached to the holder to form a shield around two sides of an area to be painted;

FIG. 7 is an elevation view showing yet another form of shield in combination with a first alternate embodiment of the shield holder of the present invention used for painting around the corner of the window;

FIG. 8 shows the use of the painting shield holder of the present invention with a shield member cut to conform to the perimeter of a building's eaves; and FIG. 9 shows a second alternate embodiment of the present invention incorporating a scraping edge.

DETAILED DESCRIPTION OF THE PREFERRED EMBODIMENT

Figure 1:
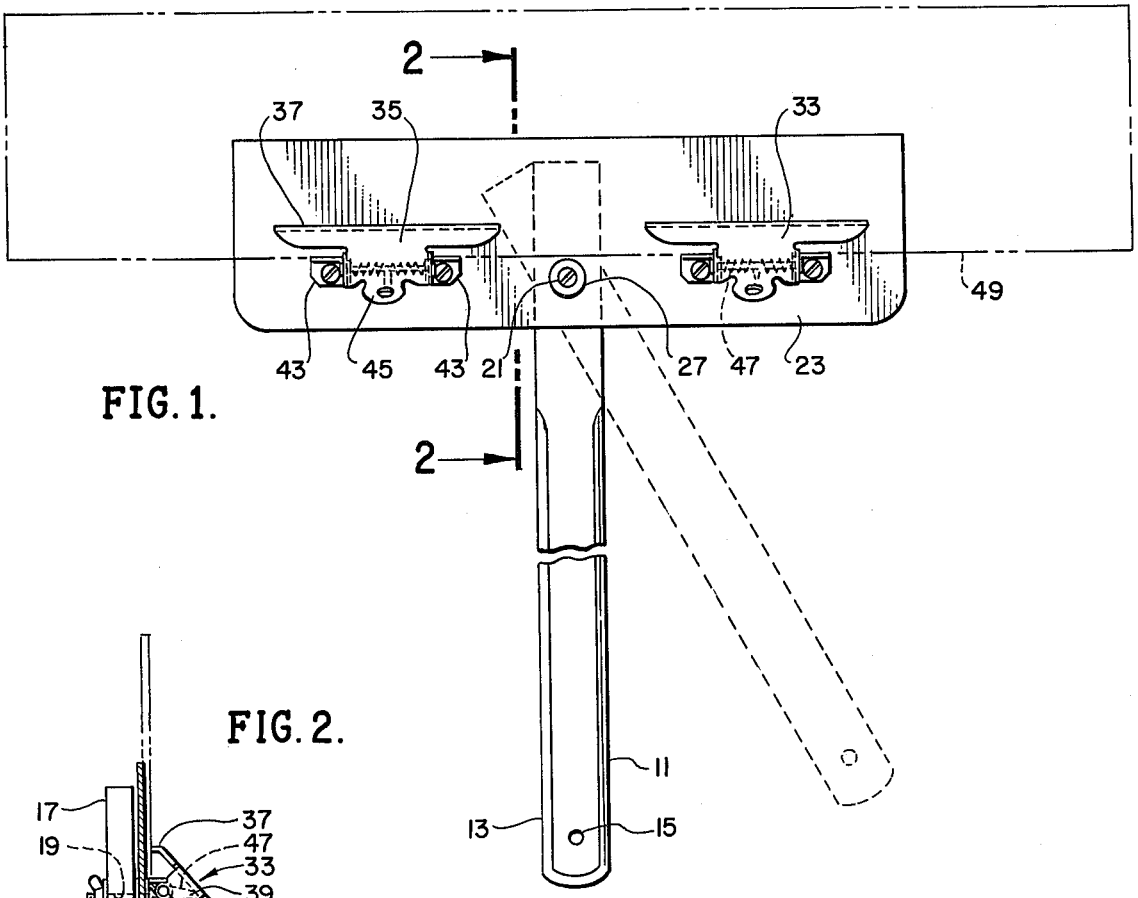
FIG. 1 is a plan view of the painting shield holder of the present invention, showing a painting shield for use therewith in phantom lines, and also showing in phantom lines an alternate position of the handle.
Figure 2:
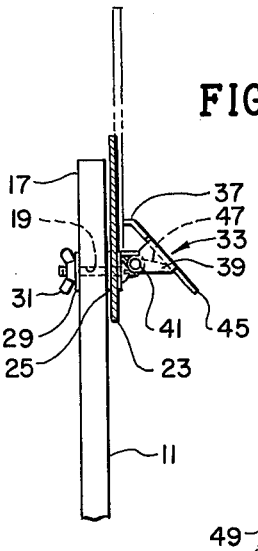
FIG. 2 is a sectional view of the painting shield holder of FIG. 1 taken along lines 2—2 of FIG. 1.

Referring initially to FIGS. 1 and 2, the spray painting shield of the present invention includes an elongate handle 11, typically constructed of wood or metal, including a rounded gripping portion 13 conveniently apertured at 15 to permit wall storage. The alternate end 17 of the handle 11, opposite the gripping portion 13, is apertured at 19 to receive a bolt 21.

The bolt 21 is used to attach the end 17 of the handle 11 to a rigid, flat reinforcing element 23 which is preferably constructed of plastic or fiberboard, typically approximately ⅛ thick, 5 wide and 17 inches long. A washer 25 surrounds the bolt 21 and is positioned between the handle 11 and reinforcing member 23, and additional washers 27 and 29 are positioned at the opposite ends of the bolt 21. A wing nut 31 is used to clamp the reinforcing member 23 to the handle 11, with the washer 25 clamped between these elements to permit pivoting even when the wing nut 31 is relatively tight.

It can be seen from the above description that the handle 11 will rotate relative the reinforcing member 23 about the bolt 21, and that the degree of frictional resistance to such rotation may be adjusted by tightening the wing nut 31. If desired, an additional wing nut or other type of nut may be attached to the threaded end of the bolt 21 to provide a locking feature to fix the amount of frictional resistance once the wing nut 31 has been adjusted.

Attached at spaced locations on opposite sides of the handle 11 are a pair of spring clips 33 and 35, each of which is substantially identical to the spring clips used on common clipboards. Thus, these spring clips, as shown in FIG. 2, include a flat blade 37 mounted by a yoke 39 to articulate about a pivot pin 41, which pivot pin is in turn rotatively mounted on a base bracket 43. The blade member 37 conveniently extends beyond the yoke 39 to provide a handle 45 for rotating the blade portion 37 away from the reinforcing member 23. A spring 47 is positioned around the pivot pin 41 to bias the spring clip blade 37 against the reinforcing member 23. Thus, when the handle 45 is released, the blade 37 bears against the reinforcing member 23.

The pair of spring clips 33 and 35 are used to hold a flat painting shield 49 against the reinforcing member 23. The shield 49 may be manufactured from metal or plastic or other lightweight sheet material, but is most often sheet cardboard material which is inexpensive and thus discardable after use. As will appear from the discussion which follows, the use of cardboard for the shield 49 also facilitates the cutting of various patterns in the shield 49 to adapt the shield 49 for surrounding various articles. The shield 49 is generally at least twice as wide and twice the length of the reinforcing member 23, and is supported to remain flat during use by being pressed against the reinforcing member 23 by the spring clips 33, 35.

Figure 3:
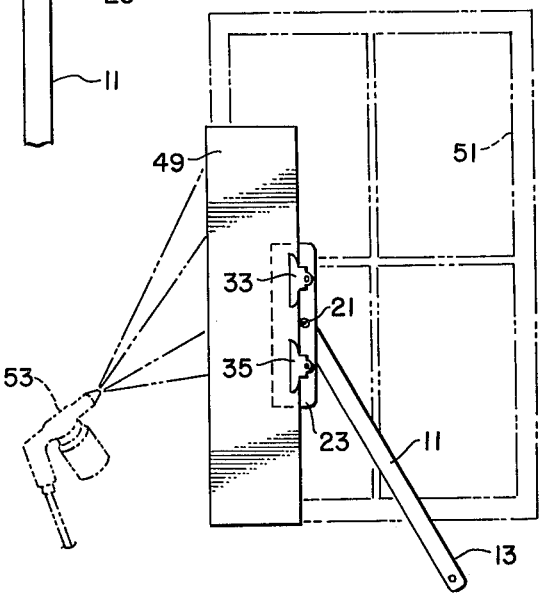
FIGS. 3 and 4 are elevation views showing the painting shield holder of the present invention combined with a painting shield as used for painting various portions of a wall surrounding a window.
Figure 4:
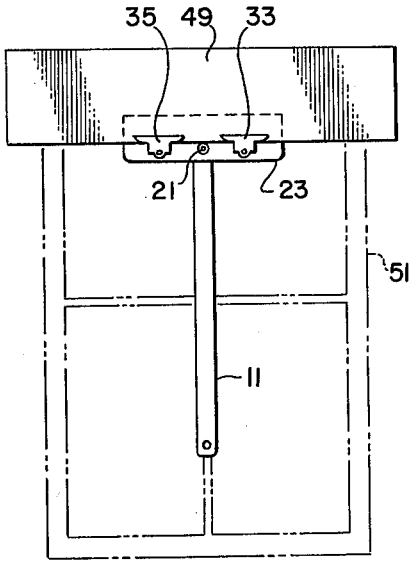

FIGS. 3 and 4 illustrate the use of the device shown in FIGS. 1 and 2 and, in particular, the importance of the rotational interconnection of the handle 11 to the reinforcing member 23 through the bolt 21. FIG. 3 illustrates the use of this device for painting along the left side of a window 51 by aligning the left edge of the shield 49, as viewed in FIG. 3, along the left side of the window 51. In this instance, if the window 51 is at an elevated location, the painter will grasp the hand grip end 13 of the handle 11 with his right hand and will grasp the spray gun 53 with his left hand, applying paint along the left edge of the shield 49. As can be seen, the gripping portion 13 of the handle 11 is well out of the path of the spray from the gun 53 so that paint cannot fall on the operator's right hand, and the gun 53 cannot injure the operator.

The handle 11 may, of course, be positioned in a perpendicular direction from the shield 49, as shown in FIG. 4, for painting at locations such as directly above the window 51. It will be appreciated that for each of the positions around the window 51, the painter will articulate the handle 11 relative the reinforcing member 23 and shield 49 to best position the hand which supports the handle 11 out of the direct path of the paint spray.

Referring now to FIG. 5, the use of the present invention with a variety of shields in a variety of locations about a room will be described. Referring initially to the use of the reinforcing member 23 and handle 11 for painting the ceiling while shielding the flat surface of a wall 55, it will be seen that a rather large shield 57 is conveniently held by an assistant 59 who is well out of the way of the painter 61 and spray 53. In this instance, the large shield 57 is used to permit the assistant 59 to shield at the intersection of the ceiling and wall 55, and the handle 11 is articulated relative the reinforcing member 23 so that the assistant 59 can stand out of the way of the painter 61.

Shown positioned in a corner of the room is a preformed shield member 63 which includes a section 65 bent at a right angle relative the main shield 63. This shield is preferably made of relatively rigid material, such as sheet metal. The shield 63 is particularly adapted for painting ceilings in the corner of a room, as shown, and one flat surface of the shield 63 is attached to the reinforcing member 53 to permit the painter 61 or his assistant 59 to hold the shield 63 in place. A third position of the shield used for painting the wall and baseboard is shown in FIG. 5, wherein the standard shield 49 of FIG. 1 is positioned against the reinforcing member 23 for manipulation using the handle 11 along the floor of the room. In this instance, the painter himself will probably grasp the handle 11 and will rotate it relative the reinforcing member 23 as he manipulates the shield 49 along the wall and into the corners of the room.

FIG. 6 shows the reinforcing member 23 of the present invention attached to the handle 11 and supporting a pair of smaller shield members 67 and 69 positioned at right angles to one another and overlapped under the spring clip 35. By changing the relative position of the shields 67 and 69, an L-shaped shield intersecting at a variety of angles may be constructed by the painter to paint objects such as the vent 71 and to shield the wall surrounding the vent 71. It can be seen that, as situated in FIG. 6, the lower left hand corner of the vent 71 will be painted. If the painter then wishes to paint the lower right hand corner, he can rotate the reinforcing member 23 counterclockwise about the handle 11 to position the shield 67 along the right hand side of the vent 71 and the shield 69 along the lower edge. Through a series of such rotations, the entire vent 71 can be painted without removing the shields 67 and 69 from the reinforcing member 23.

FIG. 7 shows a specially constructed L-shaped shield 73 which may be used for painting the wall surrounding the corner of a window 51. FIG. 7 shows an embodiment of the shield holder of the present invention wherein the handle 11 is rotatably attached by a bolt, as in the case of the embodiment of FIG. 1, but to a smaller reinforcing member 75 which supports a single shield clip 77. This smaller version of the embodiment of FIG. 1 may be convenient for holding small shield members 73 for painting around relatively small objects, such as the corner of the window 51.

FIG. 8 shows the primary embodiment of the shield holder of FIG. 1, including the reinforcing member 23 and handle 11, supporting a specially constructed shield 79 which includes notches 81, cut by the painter in the field or manufactured for sale, and designed to engage around rafters 83 at the eaves of a building 85 to permit painting of the eaves of the building without applying paint to the walls. It can be seen that, through the use of the holder of this invention, a painter using cardboard sheets can construct any number of specially adapted shields 79 for painting such elements as the eaves of the building 85, discarding such shields 49 after their use.

Referring now to FIG. 9, a second alternate embodiment of the present invention will be described. This embodiment includes an identical handle 11 but a smaller reinforcing member 87 with a single shield clip 89 attached thereto, as by bolts 91. As in the prior embodiments, the handle 11 is attached by a bolt 93 to rotate relative the reinforcing member 87. In this embodiment, however, a thin strip of rigid sheet material, such as sheet metal 95, is attached, as by rivets 97, along the edge 99 of the reinforcing member 87 opposite the handle 11. By tightening the bolt 93 to form a relatively rigid structure, the apparatus shown in FIG. 9 may be used as an occasional scraper by the painter. In this instance, the painter removes the shield from the device and scrapes a wall or other surface with the blade 95. In addition, it will be recognized that spray painters are occasionally required, as at baseboards or other positions, to do a small amount of brush work at the perimeter of a sprayed area. In this instance, the thin sheet metal member 95 may be positioned adjacent or under the baseboard or other element to act as an edge guide for such brush painting.

The present invention permits the use of a variety of shields, either manufactured or produced in the field by the painter, to accommodate various perimeters which must be painted. The use of the rotating handle 11 permits the painter to shield various areas with a single shielding device while still assuring that at all times his hands and arms are well out of the path of his spraying equipment to avoid painting his hands and arms and injury thereto.

What is claimed is:

1. Apparatus for shielding protected areas during spray painting operations, comprising:

an elongate handle, one end of which includes a gripping portion, the other end of which includes an aperture normal to the longitudinal axis of said handle;

a rigid, flat reinforcing member having a length and width shorter than the length of said elongate handle, said reinforcing member lying flat against the side of said handle at said other end of said handle, said reinforcing member lying in a plane parallel to the longitudinal axis of said elongate handle, said reinforcing member including an aperture corresponding with said handle aperture;

a pivot shaft passing normal to the longitudinal axis of said handle through said handle aperture and said reinforcing member aperture to permit said handle to pivot freely to any position in a 180° arc within a plane parallel to the plane defined by said reinforcing member; and a painting shield, formed of thin sheet material, removably attached to said flat reinforcing member and extending beyond said reinforcing member on at least one side thereof, the plane defined by said painting shield, the plane defined by said reinforcing member, and the plane defined by the pivoting movement of said handle all being parallel to each other and perpendicular to said pivot shaft.

2. Apparatus for shielding as defined in claim 1 additionally comprising:

a spring-biased clamp attached to said reinforcing member for clamping said shield flat against said reinforcing member in a plane parallel to the plane defined by said reinforcing member, and parallel to the plane defined by the pivoting movement of said handle.

3. Apparatus for shielding as defined in claim 1 additionally comprising:

adjustable friction means mounted on said pivot shaft for changing the rotational friction between said handle and said reinforcing member.

* * * * *